US006951315B2

(12) United States Patent
Schneider

(10) Patent No.: US 6,951,315 B2
(45) Date of Patent: Oct. 4, 2005

(54) TUBULAR ROTARY MILL LINER

(75) Inventor: Robert Schneider, Beaufays (BE)

(73) Assignee: Comigam Ltd., Port Louis (MU)

( * ) Notice: Subject to any disclaimer, the term of this patent is extended or adjusted under 35 U.S.C. 154(b) by 134 days.

(21) Appl. No.: 10/311,089

(22) PCT Filed: Jun. 14, 2001

(86) PCT No.: PCT/EP01/06867

§ 371 (c)(1),
(2), (4) Date: Oct. 22, 2003

(87) PCT Pub. No.: WO01/97975

PCT Pub. Date: Dec. 27, 2001

(65) Prior Publication Data

US 2004/0113004 A1 Jun. 17, 2004

(30) Foreign Application Priority Data

Jun. 23, 2000 (EP) ..... 00202178
Oct. 18, 2000 (LU) ..... 90653

(51) Int. Cl.[7] ..... B02C 17/22
(52) U.S. Cl. ..... 241/299; 241/183
(58) Field of Search ..... 241/299, 182, 241/183

(56) References Cited

U.S. PATENT DOCUMENTS 4,211,370 A 7/1980 Wilson
4,515,319 A * 5/1985 Wei ..... 241/284

FOREIGN PATENT DOCUMENTS

DE 833 892 3/1952

OTHER PUBLICATIONS

Montvila V V, *Soviet Inventions Illustrated*, Section PQ, Week 8539, Nov. 8, 1985, Derwent Publications Ltd. and Montvila V V, Mar. 15, 1985 Abstract.

* cited by examiner

*Primary Examiner*—Mark Rosenbaum
(74) *Attorney, Agent, or Firm*—Leydig, Voit & Mayer, LTD

(57) ABSTRACT

The invention concerns a liner consisting of juxtaposed individual rings of lining plates forming the cover of the cylindrical housing of a rotary mill. The liner consists of a number of lining plates located at selected sites and configured in the form of deflectors (20, 30) comprising a fin (26, 36) arranged on edge on a base plate (22, 32) fixed to the housing and forming an angle less than 25° relative to a diametral plane of the mill.

13 Claims, 4 Drawing Sheets

FIG. 7
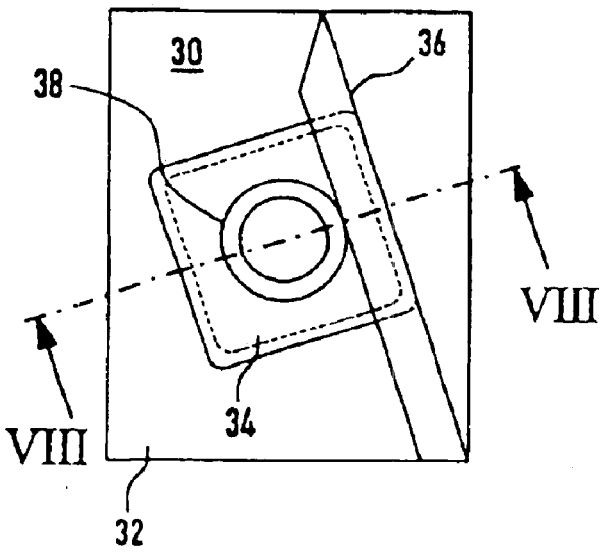
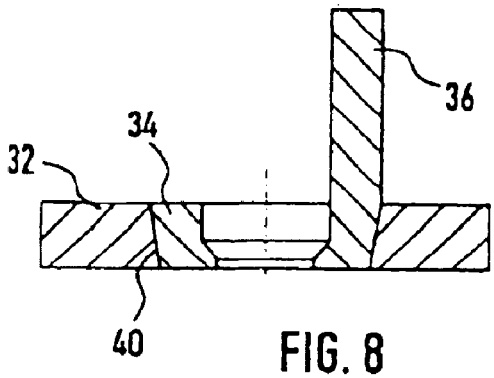
FIG. 8
FIG. 9
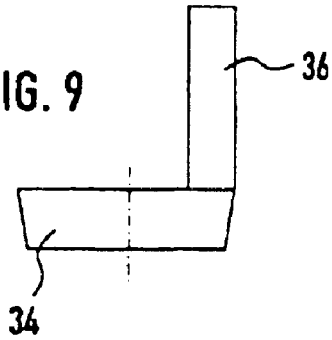
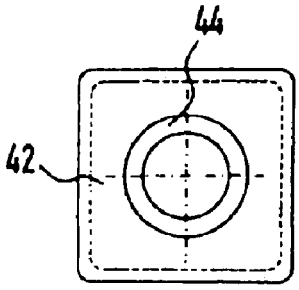
FIG. 10
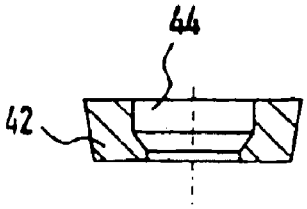
FIG. 11

TUBULAR ROTARY MILL LINER

CROSS-REFERENCE TO RELATED PATENT APPLICATIONS

The international application was not published under PCT Article 21(2) in English, but was published in French. This patent application is a U.S. Nationalization of PCT application number PCT/EP01/06867 filed Jun. 14, 2001, which is a PCT of EP application No. 00 202 178.0 filed Jun. 23, 2000, and LU application No. 90 653 filed on Oct. 18, 2000.

FIELD OF THE INVENTION

The present invention relates to a liner for a rotary tubular mill comprising a cylindrical shell ring intended to contain material that is to be ground and a charge of grinding bodies, in which the liner comprises rings of juxtaposed individual liner plates.

BACKGROUND OF THE INVENTION

The invention is aimed more specifically at mills used for grinding cement (clinker) by a dry route, coal, limestone and ores by the wet or dry route. These mills comprise a metal cylindrical shell ring rotating about its longitudinal axis and containing a grinding charge comprising grinding bodies, generally balls, but which may also comprise cylindrical pebbles, spherical pebbles, etc. of various sizes. The material for grinding is introduced on one side of the mill and, as it progresses toward the outlet on the opposite side, it is crushed and ground between the grinding bodies.

A conventional mill is generally divided, in the axial direction, by means of a diametral partition wall, into two successive chambers. The first chamber in which the coarse crushing of the material takes place contains grinding balls which generally have a diameter of between 60 mm and 90 mm. The second chamber, in which fine grinding takes place, contains grinding balls of a diameter generally between 15 mm and 60 mm. Besides these two-chamber mills there are also mills with just one chamber which contain grinding bodies of different diameters and in different quantities according to the diameter.

In the second chambers of conventional mills or in single-chamber mills, it is well known that it is necessary to have self-classifying liners, that is to say liners which, as the mill rotates about their axis, automatically classify the grinding bodies according to their size and more specifically classify the large grinding bodies at the inlet of the grinding chamber and the smaller ones toward the outlet of this same chamber, this being so that the weight and the size of the grinding bodies decrease as the particle size of the material progressing through the grinding chamber reduces and becomes finer. In this way, over the length of the grinding chamber, the size of the grinding bodies is suited to the particle size and fineness of the material that is to be ground. This generally makes it possible to reduce the power consumption per ton of ground material by 10 to 20%.

There are currently in existence various types of self-classifying liners. One of them has a saw-tooth shape in the axial direction of the mill, that is to say comprises a succession of cone frustums along the length of the mill which converge toward the outlet and have a slope directed toward the inlet of the grinding chamber. The plates which form these liners have a relatively high mean thickness and are therefore fairly heavy. This high thickness also leads to a loss of working volume in the grinding chamber and therefore, in some cases, to an inability to absorb all the available power of the motor. These liners are also very sensitive to the grains, that is to say that when there is a certain build-up of very hard grains (about 6 to 12 mm) in the regions where the small grinding bodies are located, classification is highly disrupted, it being possible for this disruption to go so far as to classify the bodies in reverse order, that is to say to send small bodies back toward the inlet and large bodies toward the outlet.

In another type of liner as described in document BE 09301481, the plates have corrugations which may be inclined by an angle of 15 to 30° with respect to the generatrix of the mill. The purpose of inclining these corrugations is to create a screw effect to act on the grinding charge and on the material to be ground. What happens is that when the mill turns, the large grinding bodies generally, for the most part, find themselves at the periphery of the grinding charge and the purpose of inclining the corrugations is to push these grinding bodies by a screw effect back toward the inlet of the grinding chamber. In practice, the classification desired in this way is, however, very difficult and often haphazard. The plates are also relatively heavy and the classification effect reduces as the corrugations gradually wear. These corrugations cannot be excessively pronounced because if they are there is discontinuous pickup, that is to say excessive pickup during which the outer layers of the grinding charge are picked up to the region of the top of the mill and drop back onto the liner instead of falling and rolling along the foot of the grinding charge. These liners are, in practice, very little used.

BRIEF SUMMARY OF THE INVENTION

The purpose of the present invention is to provide a new liner for a tubular mill which makes it possible to eliminate or, at the very least, to reduce the disadvantages of the conventional liners, more specifically a mill with a lighter weight liner which makes it possible to create good classification, which is effective and very flexible to use.

To achieve this objective, the present invention envisages a tubular mill of the kind described in the preamble which is characterized in that a certain number of liner plates located at selected points are formed in the form of deflectors comprising a fin standing up on end on a baseplate fixed to the shell ring and forming an angle smaller than 25° with respect to a diametral plane of the mill.

The lateral side of the fin on the front side, when viewed in the direction in which the mill rotates, is preferably chamfered, the chamfering being on the face facing toward the inlet side of the mill.

This chamfered lateral side of the fin is, with respect to the direction in which the material progresses, set back with respect to the opposite lateral side.

This inclination of the fins, which is preferably in excess of 5°, thus creates a helix effect which encourages the material to progress and plays a part in classifying the grinding bodies.

The fin may form an integral part of the baseplate and may be cast with it.

The fin may also be a separate piece, secured to a plinth equipped with a hole so that it can be fixed to the shell ring of the mill. This plinth may have a frustoconical periphery which can enter an opening of complementing shape in a baseplate. Thus, the fixing of the fin by its plinth at the same time fixes the baseplate to the shell ring.

BRIEF DESCRIPTION OF THE DRAWINGS

Other particulars and features of the invention will become apparent from the description of some embodiments given hereinbelow, by way of illustration, with reference to the appended drawings in which:

FIG. 7 schematically shows a plan view of a second embodiment of a deflector;

FIG. 8 shows a cross section of sectioning plane VIII—VIII of FIG. 7;

FIG. 9 shows a profile view of a fin with its plinth;

FIG. 10 shows a plan view of a filler piece;

FIG. 11 shows a view in cross section through the piece of FIG. 10, and

DETAILED DESCRIPTION OF THE INVENTION

Figure 1:
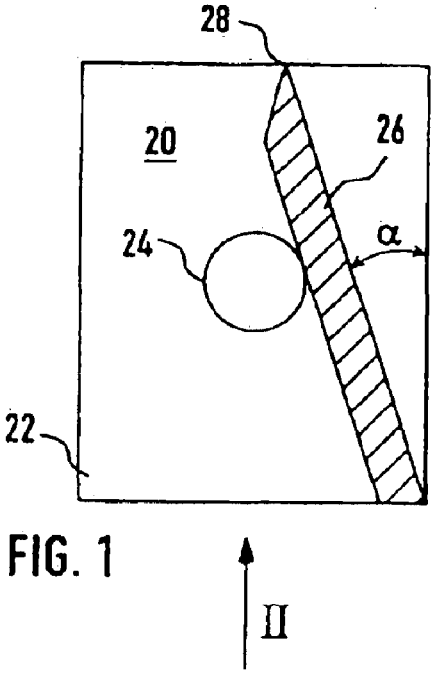
FIG. 1 is a schematic plan view of a first embodiment of a deflector according to the present invention.
Figure 2:
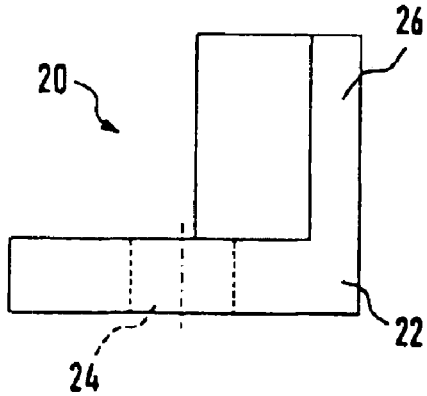
FIG. 2 is a profile view of the same deflector viewed in the direction of arrow II of FIG. 1.

According to the present invention, a certain number of liner plates are formed in the form of deflectors 20 such as depicted in FIGS. 1 and 2, of which FIG. 1 is a view looking down on a deflector 20 while FIG. 2 is a view in profile in the direction of arrow II of FIG. 1 which also depicts the direction of rotation of the mill. Each deflector comprises a baseplate 22 equipped with a central hole 24 to be fixed to the interior wall of the shell ring of the mill.

On the plate 22 and forming an integral part thereof (cast in) in the embodiment of FIGS. 1 and 2 there is a fin 26 which stands up on end on the plate 22, preferably normal to the latter. This fin 26 may have a thickness of between 25 and 50 mm and a height (radial with respect to the mill) preferably of between 100 and 350 mm.

According to an important feature of the invention, each fin 26 is inclined with respect to a diametral plane of the mill by an angle a smaller than 25°, preferably of between 5° and 25°, depending on the operating conditions of the mill and on the nature of the grinding charge and of the material that is to be ground.

The lateral side of the fin 26 which is on the front side, viewed in the direction in which the mill rotates, is chamfered, in the embodiment of FIGS. 1 and 2, on the face of the fin 26 which faces toward the inlet of the mill, to form a fairly sharp edge 28. This edge 28 eases penetration into the charge and plays a part in continuous pickup, that is to say prevents the grinding bodies from being thrown onto the liner.

The fins 26 will generally be made of very hard cast iron or steel if the working conditions of the mill are more arduous, for example in the case of the use of grinding balls 90 mm in diameter. For fine grinding, with milder working conditions, the working face of these deflectors, that is to say the face facing toward the outlet side of the mill (toward the right in FIG. 1), and the edge 28 may be rendered more resistant to wear by abrasion through the use of "padding" (that is to say a mixture of metal and ceramic material). These regions may also be protected by very hard tungsten carbide weld beads for example.

Figure 3:
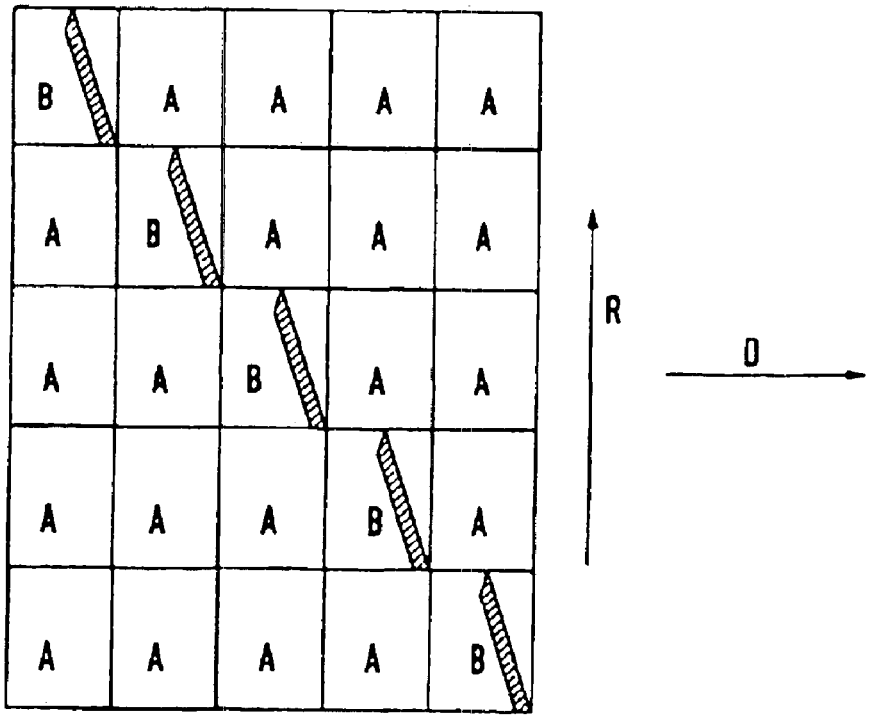
FIGS. 3 to 6 schematically illustrate various configurations of the location of the deflectors on the interior wall of the shell ring.
Figure 4:
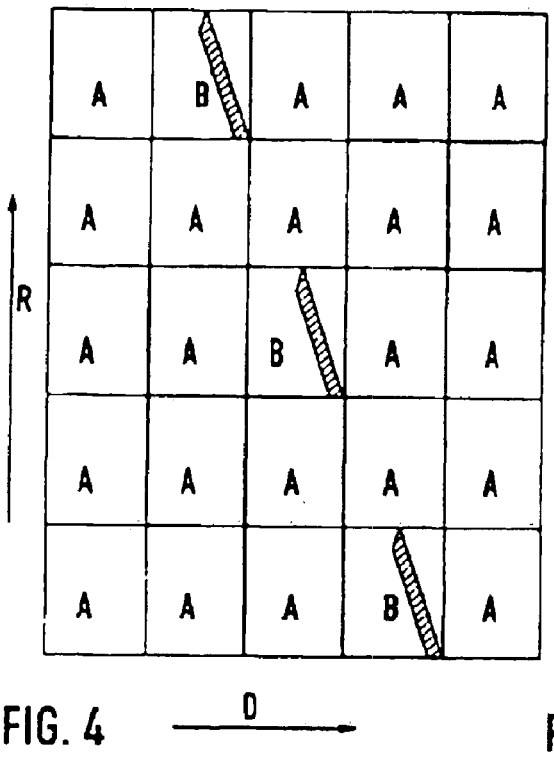
Figure 5:
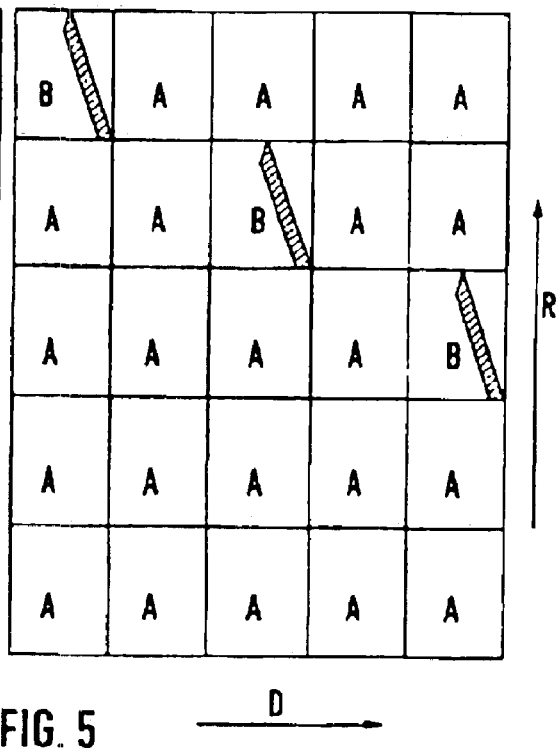

FIGS. 3, 4 and 5 each a show a part of the shell ring of the mill in development with various exemplary configurations of the placement of the deflectors. In each of these figures, the arrow R denotes the direction of rotation of the mill while the arrow D denotes the direction of displacement of the material to be ground. The plates denoted by A are normal conventional plates while the plates denoted by B are plates designed in accordance with the present invention as deflectors.

According to FIG. 3, each deflector B is next to another deflector B at two diametrally opposed comers, in order thus to define a complete or partial spiral right around the inside of the shell ring.

FIG. 4 shows a configuration similar to that of FIG. 3 except that between a deflector B and two neighboring deflectors of the same spiral there is a longitudinal row of deflector-free plates A.

FIG. 5 shows an exemplary configuration similar to that of FIG. 4, but here, each deflector B is separated from the neighboring deflectors of the same spiral by a diametral row of deflector-free plates. It is to be noted that, in this configuration, the axial spacing between two neighboring deflectors is greater than in the configurations of FIGS. 3 and 4.

In a complete liner, the number of deflectors can vary between 5% and 15% of the total number of liner plates.

Figure 6:
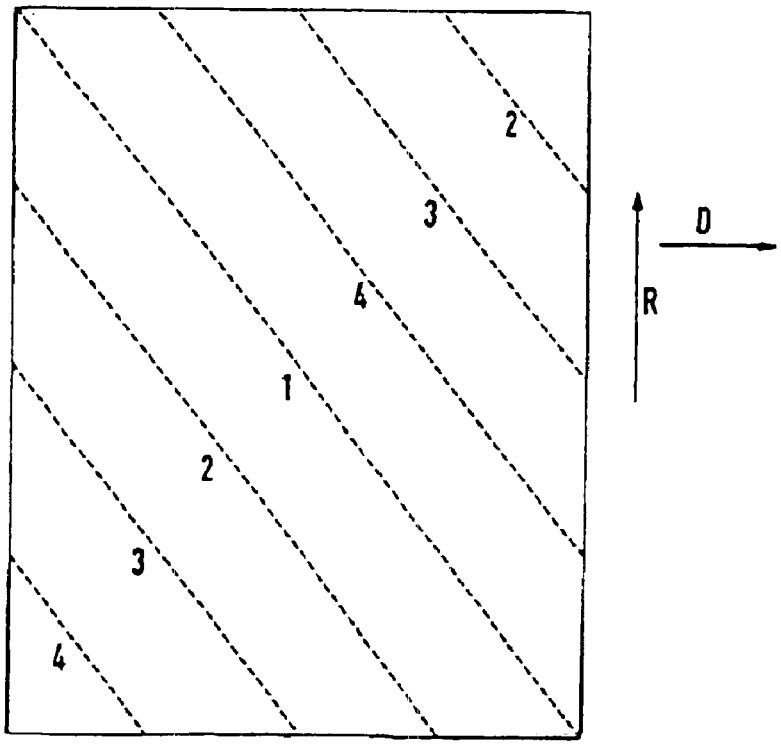

FIG. 6 shows the complete development of a shell ring of a mill 4 meters in diameter and 10 meters long. The deflectors are arranged in a spiral in the mill according to the configuration of FIG. 3. In such a perforated mill to the DIN standard there are 40 plates along the circumference and 40 plates along the length, namely a total of 1600 plates. If there are 10% deflectors, namely 160 deflectors, these are arranged in four spirals of 40 plates each in the mill. These spirals are depicted schematically in FIG. 6 and numbered 1, 2, 3 and 4 successively.

It is also possible to modify the distance between two neighboring spirals along the length of the mill. For example, it is possible to pull the spirals closer together toward the outlet of the mill, that is to say to provide more deflectors there.

As the mill rotates, all these deflectors enter the grinding charge like the plowshare of a plow and their inclination with respect to a diametral plane combined with the spiral-shaped configuration of the deflectors discharges the grinding charge toward the outlet of the mill. The grinding charge is thus inclined with respect to the longitudinal axis of the mill by something of the order of 0.5° to 2°.

The consequence is that the degree of fill measured at the inlet to the mill is a little lower than that measured at the outlet of the grinding chamber.

The largest grinding bodies therefore run more quickly than the smaller grinding bodies along the foot of the grinding charge, that is to say from the rear of the mill toward its inlet. This method of classification of the grinding bodies is very effective. It also has another major advantage because the degree of fill increases from the inlet toward the outlet. Indeed it is known that the best grinding efficiency is obtained when the voids between the grinding bodies (more or less 41%) are filled with material and that the material to be ground, in progressing through the mill, "inflates" (that is to say that its apparent density decreases). It is therefore beneficial to have a higher degree of fill at the outlet of the mill in order to optimize the grinding efficiency.

Another advantage is that the material to be ground is pushed more quickly through the mill and, because of these deflectors, there is better mixing between the grinding bodies and the material to be ground.

As was mentioned above, the deflector shown in FIGS. 1 and 2 is a one-piece part produced by casting. An embodiment with a composite deflector will be described hereinbelow with reference to the next figures.

This composite deflector denoted overall by the reference 30 in FIG. 7 comprises a fin 36 comparable with the fin 26 of FIGS. 1 and 2 but provided, at its base, with a plinth 34 which, in the embodiment depicted, has a square shape. The plinth 34 and the fin 36 form a one-piece part which can be produced by casting but which is separate from the baseplate 32. This baseplate has an opening 40 of a shape that complements that of the plinth 34 and which forms a surround to receive this plinth.

As shown by FIGS. 8 and 9, the plinth 34 and the opening 40 in the baseplate 32 have complementing frustoconical cross sections which means that when the plinth 34 is arranged in its housing in the baseplate 32 and fixed, through its fixing hole 38, to the shell ring of the mill, the baseplate 32 is held in place by the plinth 34 and no longer needs to be fixed to the shell ring.

According to an advantageous embodiment, filler pieces 42 depicted in FIGS. 10 and 11 are provided. These filler pieces 42 have exactly the same shape and the same cross section as the plinths 34 shown in FIGS. 7 to 9 but have no fins 36. These pieces allow the openings 40 in the baseplates 32 to be filled when there is a desire, to selectively remove certain deflectors 30 shown in FIGS. 7 to 9. All that is then actually required is for the plinth 34 to be unbolted and removed with its fin 36, and for the opening to be re-plugged using the filler piece 42 and for the latter to be bolted to the shell ring through its central opening 44.

It is also possible to provide a certain number of baseplates with a filler piece 42, thus making it possible, if need be, to convert a baseplate into a deflector by replacing the filler piece 42 with a fin 36 and a plinth 34. It is thus possible, as desired, to increase or reduce the number of deflectors and to change the interior configuration of the location of the deflectors.

The fins 26 and 36 shown in the various figures are suited, because of their chamfered edge 28, only to a mill rotating in the direction indicated in FIGS. 1 and 3 to 5. In a mill rotating in the opposite direction, deflectors which are symmetric with those shown in the figures need to be provided.

Tests performed on a small-scale pilot station have demonstrated that, for a perforated mill to the DIN standard (that is to say with plates with a circumferential arc length of 314.16 mm and a length of 250 mm in the axial direction of the mill), a satisfactory number of plates converted into deflectors is of the order of ±10%.

This number may, however, vary with the operating conditions of the mill:

a) for a low degree of fill (±20%) of the mill, the number of deflectors is higher when the speed expressed as a percentage of the critical speed is low. The critical speed is the rotational speed of the mill at which centrifuging occurs and this speed is determined by the formula:

$$\frac{42.3}{\sqrt{D}},$$

expressed in the number of revolutions per minute, D being expressed in meters for the diameter of the mill. For a perforated mill to the DIN standard, that is to say with plates measuring 314.16 mm by 250 mm, the following values are obtained:

from 55% to 65% Vcr (critical speed): number of deflectors: about 9%;

from 65% to 75% Vcr: number of deflectors: about 8%;

from 75% to 85% Vcr: number of deflectors: about 7%, b) with a degree of fill of ±30%, the following values will be had:

from 55% to 65% Vcr: number of deflectors: about 11%;

from 65% to 75% Vcr: number of deflectors: about 10%;

from 75% to 85% Vcr: number of deflectors: about 9%, c) with a degree of fill of ±40%, the following values will be had:

from 55% to 65% Vcr: number of deflectors: about 13%;

from 65% to 75% Vcr: number of deflectors: about 11%;

from 75% to 85% Vcr: number of deflectors: about 10%.

The height of the deflectors essentially depends on the diameter of the mills. By way of example:

for diameters of between 1.5 and 2.5 m: ±100 mm in height, for diameters of between 2.6 and 3.6 m: ±200 mm in height, for diameters of between 3.7 and 4.8 m: ±250 mm in height, for diameters of between 4.9 and 6.2 m: ±300 mm in height.

It should be noted that, if the height of the deflectors increases, their number may decrease.

Standard baseplates generally have an average thickness of ±40 mm, that is to say that a plate to the DIN standard (314.16×250 mm) has a weight of the order of 24 kg. In the case of composite deflectors according to FIGS. 7 to 9, a fin and a plinth together weigh a maximum of 25 kg. In consequence, from the point of view of ergonomics and safety on fitting the liner, the proposed deflectors do not constitute a handicap.

The invention also has the advantage of allowing a fairly significant saving in the weight of liner per $m^2$. For a second grinding chamber 4.8 meters in diameter and 10 meters long, this is quantified as follows:

area to be lined: 150.8 $m^2$;

weight of a standard classifying liner: 465 kg/$m^2$, namely a total of 70 122 kg;

weight of a liner according to the invention with 10% deflectors: 350 kg/$m^2$ namely a total of 52 800 kg.

The comparison reveals a weight reduction of almost 25%.

If it were necessary to provide 15% of plates designed as deflectors, the weight per $m^2$ would be 366 kg corresponding to a total weight of ±55 200 kg, namely still a reduction of the order of 20%. In the case of a standard classifying liner, the problem that not all of the available power of the motor driving the mill can be absorbed is sometimes experienced. This is due to the average thickness of these liners which reduces the useful interior volume of the mill.

In the case of a mill 4.8 meters in diameter by 14.3 meters working length rotating at 14.48 revolutions per minute (namely 75% of the critical speed) with a degree of fill of 30% of grinding bodies and a useful length of 4.3 meters in the first chamber and 10 meters in the second chamber, the following values are had:

average thickness of a standard classifying liner: 87 mm;

average thickness of the new liner with deflectors: 44 mm;

the power absorbed with the standard classifying liner for the second chamber is of the order of 3256 kWh;

the power absorbed with the new liner with deflectors for this second chamber is of the order of 3451 kWh, namely an increase of 6%.

For the overall mill, that is to say the two chambers, there will be, when the second has standard classifying plates, a total power of 4754 kWh. By contrast, when the second chamber is provided with the new liner, the total power will be of the order of 4949 kWh, namely a favorable difference of 4%, which results in an increase in flow rate of the order of 4%.

Figure 12:
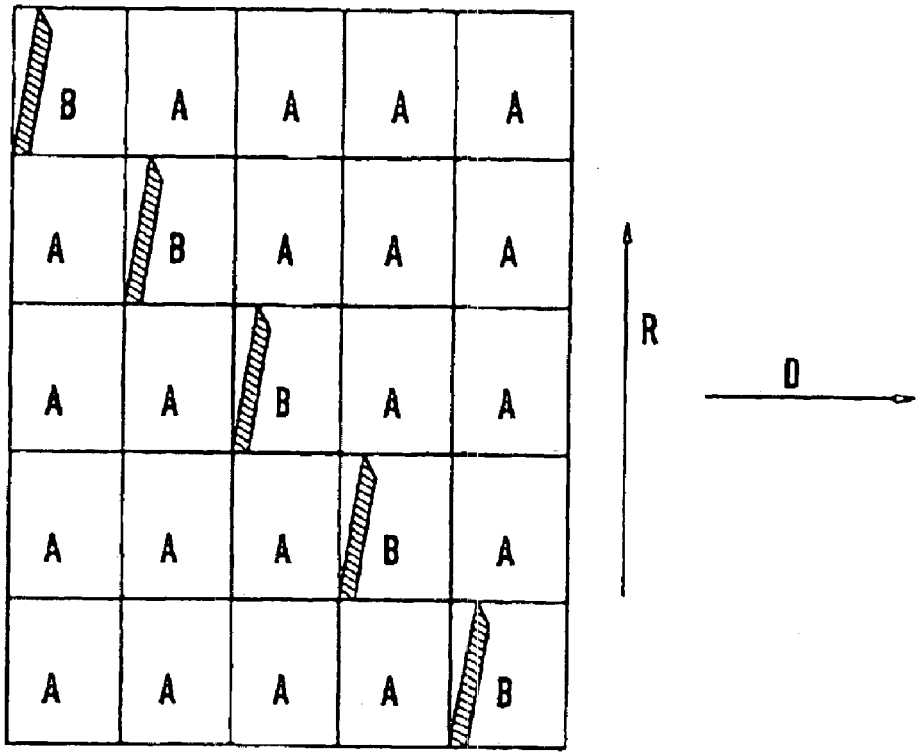
FIGS. 12 and 13 show views similar to those of FIG. 3 of an embodiment with the deflectors in another orientation.
Figure 13:
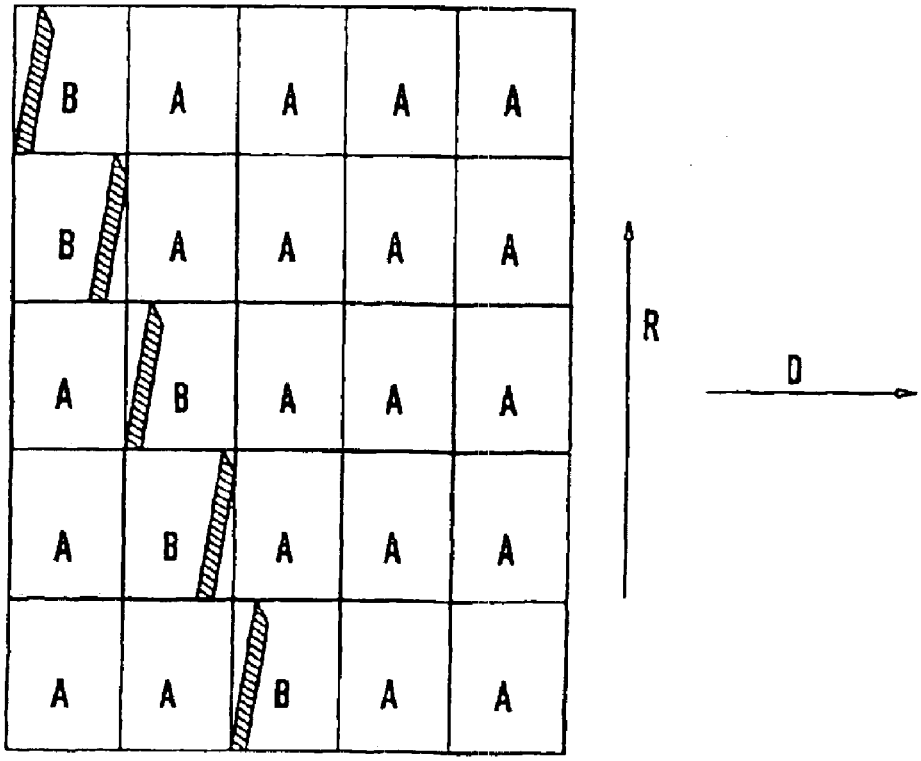

FIGS. 12 and 13 show part of the shell ring of the mill, in development with an embodiment in which the deflectors of the plates B are oriented in the opposite direction to the embodiment of the preceding figures. While the fins are still inclined by an angle of between 5° and 25° with respect to a diametral plane, this inclination in FIGS. 12 and 13 is in the direction toward the outlet of the mill, that is to say that the lateral leading side, viewed in the direction of rotation, which is also the chamfered side, is this time closer to the outlet of the mill than the opposite side. The deflectors are also chamfered on that face of the fin which faces toward the outlet of the mill rather than on the opposite face as they were in the embodiment of the preceding figures. The mutual arrangement of the various deflectors B is, however, still with a view to obtaining a spiral configuration the inclination of which can, however, vary as a comparison between FIGS. 12 and 13 proves.

Tests with a mill the liner of which was designed according to the embodiment of FIGS. 12 and 13 surprisingly proved that the effect of classifying the grinding bodies was at least as effective as the effect produced with the embodiment of the preceding figures. From this it can therefore be concluded that, as far as the classification effect is concerned, configuring the various deflectors in a spiral or twist along the length of the mill is at least as important and as deciding a factor as the direction in which the individual fins are inclined with respect to a diametral plane of the mill.

The mutual arrangement of the deflectors B in the embodiment of FIG. 12 is the same as that of FIG. 3 and configurations of the spirals produced are roughly the same.

In the embodiment of FIG. 13, the spiral is not as steep as the one in FIG. 12. For this, the deflectors B are associated in pairs in successive adjacent rings. In order nonetheless to produce a spiral configuration, the fins of the two adjacent deflectors B of the same ring are arranged, one on the inlet side of the deflector and the other on the outlet side of the deflector.

It goes without saying that the deflectors of FIGS. 12 and 13 may either be one-piece cast components as illustrated in FIGS. 1 and 2 or composite components according to FIGS. 7 to 11. Likewise, the working face of the fins in FIGS. 12 and 13 (which this time is the face facing toward the inlet side of the mill) may be worked or have incrustations to increase their resistance.

What is claimed is:

1. A liner for a rotary tubular mill comprising a cylindrical shell ring intended to contain material that is to be ground and a charge of grinding bodies, in which the liner comprises rings of juxtaposed individual liner plates, characterized in that a certain number of liner plates located at selected points are formed in the form of deflectors (20, 30) comprising a fin (26, 36) standing up on end on a baseplate (22, 32) fixed to the shell ring and forming an angle smaller than 25° with respect to a diametral plane of the mill and in that the positions of the deflectors (20, 30) are selected so that all the deflectors together form a spiral configuration.

2. The liner as claimed in claim 1, characterized in that the fin (26, 36) of each deflector (20, 30) makes an angle of between 5 and 25° with respect to a diametral plane of the mill.

3. The liner as claimed in claim 1, characterized in that the lateral side of the fin (26, 36) on the front side, when viewed in the direction in which the mill rotates, is chamfered to form a sharp edge (28), the chamfer being on the face facing toward the inlet side of the mill.

4. The liner as claimed in claim 3, characterized in that the chamfer is on that face of the fin which faces toward the inlet side of the mill.

5. The liner as claimed in claim 3, characterized in that the chamfered lateral side of the fin (26, 36) is, with respect to the direction in which the material for grinding progresses, set back with respect to the opposite lateral side.

6. The liner as claimed in claim 3, characterized in that the chamfer is provided on that face of the fin which faces toward the outlet side of the mill.

7. The liner as claimed in claim 3, characterized in that the chamfered lateral side of the fin (26, 36) is, with respect to the direction in which the material to be ground progresses, in front of the opposite lateral side.

8. The liner as claimed in claim 1, characterized in that the fin (26) forms an integral part of the baseplate (22) and is cast with it.

9. The liner as claimed in claim 1, characterized in that the deflector (30) is a composite piece comprising a fin (36) with a plinth (34) which is arranged in an opening (40) in the baseplate (32), said opening (40) having a shape that complements that of the plinth (34).

10. The liner as claimed in claim 9, characterized in that the plinth (34) and the opening (40) have complementing frustoconical shapes so that the baseplate (32) is held in place by the plinth (34) when the latter is bolted to the shell ring of the mill.

11. The liner as claimed in claim 9, characterized by filler pieces (42) having the same shape as a plinth (34) of a fin (36) and intended to replace the latter in a baseplate (32).

12. The liner as claimed in claim 1, characterized in that the working face of the fins (26, 36) and the edge (28) have ceramic incrustations to improve their abrasion resistance.

13. The liner as claimed in claim 1 wherein the liner is incorporated in the rotary tubular mill.

* * * * *